United States Patent [19]

Snow

[11] Patent Number: 4,542,946

[45] Date of Patent: Sep. 24, 1985

[54] POWER SAFETY LOCK SYSTEM

[75] Inventor: Howard R. Snow, Caledonia, Ohio

[73] Assignee: Brand-Rex Company, Willimantic, Conn.

[21] Appl. No.: 474,359

[22] Filed: Mar. 11, 1983

[51] Int. Cl.[4] ..... H01R 13/453

[52] U.S. Cl. ..... 339/40; 339/14 P

[58] Field of Search ..... 339/40, 42, 14 P

[56] References Cited

U.S. PATENT DOCUMENTS 3,222,631 12/1965 Cohen ..... 339/40
4,113,333 9/1978 Horowitz ..... 339/14 P

FOREIGN PATENT DOCUMENTS 214335 3/1958 Australia ..... 339/40
409529 5/1934 United Kingdom ..... 339/40
434807 9/1935 United Kingdom ..... 339/40
2068651 8/1981 United Kingdom ..... 339/40

*Primary Examiner*—Gil Weidenfeld
*Assistant Examiner*—Paula A. Austin
*Attorney, Agent, or Firm*—McCormick, Paulding & Huber

[57] ABSTRACT

There is provided a power safety lock system including at least a pair of electrical contacts, one of which is adapted to be connected to ground and the other adapted to receive electrical energy. A slide bar including a substrate with a plurality of bore holes therein is adjacent to electrical contacts. A mating connector associated with the grounded electrical contact is adapted to press against an incline surface in one of the bore holes to move the slide bar from a first to a second position, thus enabling a second mating connector to make contact with the electrical contact which receives electrical energy.

5 Claims, 4 Drawing Figures

POWER SAFETY LOCK SYSTEM

BACKGROUND OF THE INVENTION

This invention relates to electrical connectors. More particularly, it relates to a system for preventing power terminals from being connected or disconnected with the system ungrounded.

When interconnecting electrical circuits, particularly with high voltages or high currents present, it is important that the system be grounded so as to avoid the dangers of electrical shock. Furthermore, if the system is ungrounded during connection or disconnection of the power terminal or terminals, it will not comply with industry safety standards. Electrical connectors which integrate the power contacts and the ground contact into the same housing solve this problem by making the ground contact somewhat longer than the power contacts. Thus the ground contact is always connected to its mating contact prior to the connection of the power contacts to their respective mating contacts. Furthermore, the ground contact is always disconnected subsequent to the disconnection of the power contacts due to its longer length. In applications where rather high levels of current are used such as, for example, in welding, shipboard and in certain theatrical fields, it would be too unwieldy to manufacture a cable jumper with connectors having fully integrated contacts and ground contacts due to the large size of the conductors. Thus, for large size conductors the conductors are usually separate for each conductor.

OBJECTS OF THE INVENTION

It is therefore the general object of the invention to provide an improved safety lock system for electrical power connections.

Another object is to provide a mechanism which prevents the connection and disconnection of power contacts prior to the connection of associated ground contacts.

It is still another object of this invention to provide a power safety lock system for conductors which are individually terminated to connectors on separate plugs or receptacles.

SUMMARY OF THE INVENTION

In accordance with one form of this invention there is provided an interlock system for electrical power connections, including at least a pair of electrical contacts. One of the electrical contacts receives electrical energy, while the other electrical contact is adapted to be connected to ground. The pair of electrical contacts are adapted to be connected to a corresponding pair of mating contacts. The electrical contacts as well as the mating connectors could be either male or female configurations. A slide bar, including a substrate having at least a pair of bore holes therein is situated adjacent the electrical contacts. At least one of the bore holes has an incline surface along a portion of one of its walls. A spring is connected to the slide bar to bias the slide bar into position. Each of the bore holes is in a slidable relationship and adjacent to a corresponding electrical contact. The slide bar has at least two positions; a first position such that the substrate disables the connection of the electrical contact which is adapted to receive electrical energy to its corresponding mating connector and a second position such that the substrate enables the connection of the electrical contact which is adapted to receive electrical energy to its corresponding mating connector. The slide bar is moved from the first position to the second position by the action of one of the mating contacts against the incline surface of one of the bore holes.

BRIEF DESCRIPTION OF THE DRAWINGS

The subject matter which is regarded as the invention is set forth in the appended claims. The invention itself however, together with further objects and advantages thereof may be better understood by referring to the following description taken in conjunction with the following drawings in which:

DESCRIPTION OF THE PREFERRED EMBODIMENT

Figure 1:
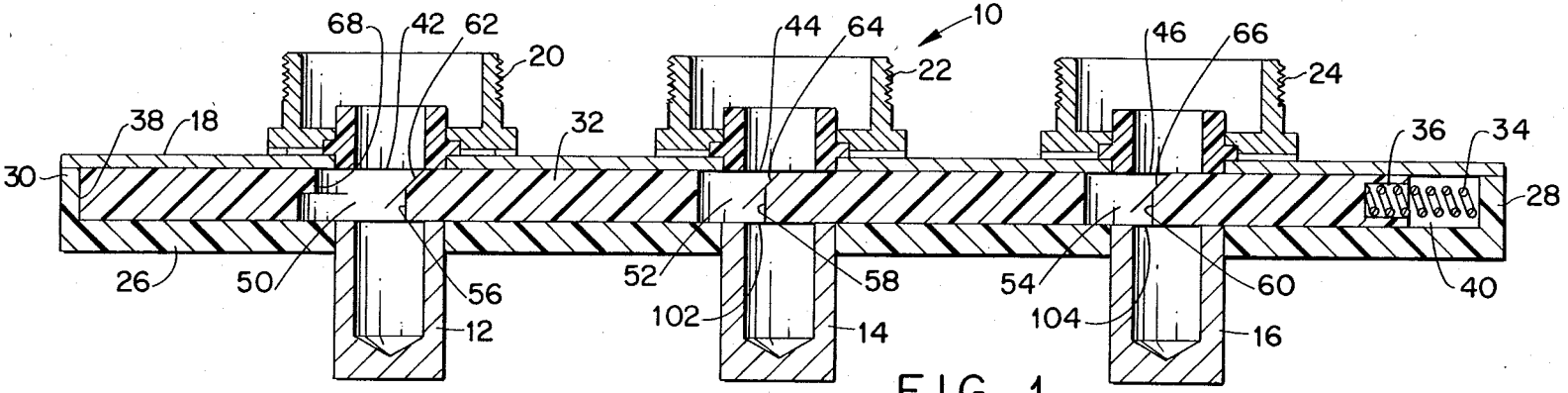
FIG. 1 is a side elevational sectional view of the power safety lock system of the subject invention with the slide mechanism in a first position.

Referring now more particularly to FIG. 1, there is provided power safety lock system 10 shown in cross-section. The safety lock system in this embodiment includes a plurality of female contacts 12, 14 and 16. Contact 12 is adapted to be connected to ground, while contacts 14 and 16 are adapted to be connected to a source of electrical energy. The safety lock system further includes mounting plate 18 upon which is mounted connector barrels 20, 22 and 24. Plate 18 is coupled to bottom plate 26 by side plates 28 and 30. Sandwiched between mounting plate 18 and bottom plate 26 is slide bar 32 and spring 34. One end of spring 34 abuts against side plate 28 and the other end is coupled to slide bar 32 with portions inserted in pocket 36. Spring 34 is shown in its elongated position which forces the slide bar such that end 38 of the slide bar abuts against side plate 30. As can be seen, the slide bar is adapted to move freely in channel 40, which is between mounting plate 18 and bottom plate 26. Mounting plate 18 includes holes 42, 44 and 46 which are drilled therethrough. Connector barrels 20, 22 and 24 cover these holes in the mounting plate. Slide bar 32 includes a substrate having bore holes 50, 52 and 54 drilled therethrough. The sidewalls 56, 58 and 60 of the bore holes include, respectively, incline surfaces 62, 64 and 66. The other side wall of bore hole 50 includes pin 68 protruding therefrom.

Slide bar 32 as shown in FIG. 1 is in its first position. Thus the portion of the slide bar which is near the respective incline surfaces covers a small portion of the hole 42 in mounting plate 18 and substantially half of the holes 44 and 46. Thus in this first position it would be impossible to insert a corresponding male plug into female contacts 14 or 16. However, since only a small portion of hole 42 is blocked by the slide bar 32 and since the incline surface 62 is engagable through hole 42, it is possible to insert a grounded contact into ground plug 12.

Figure 2:
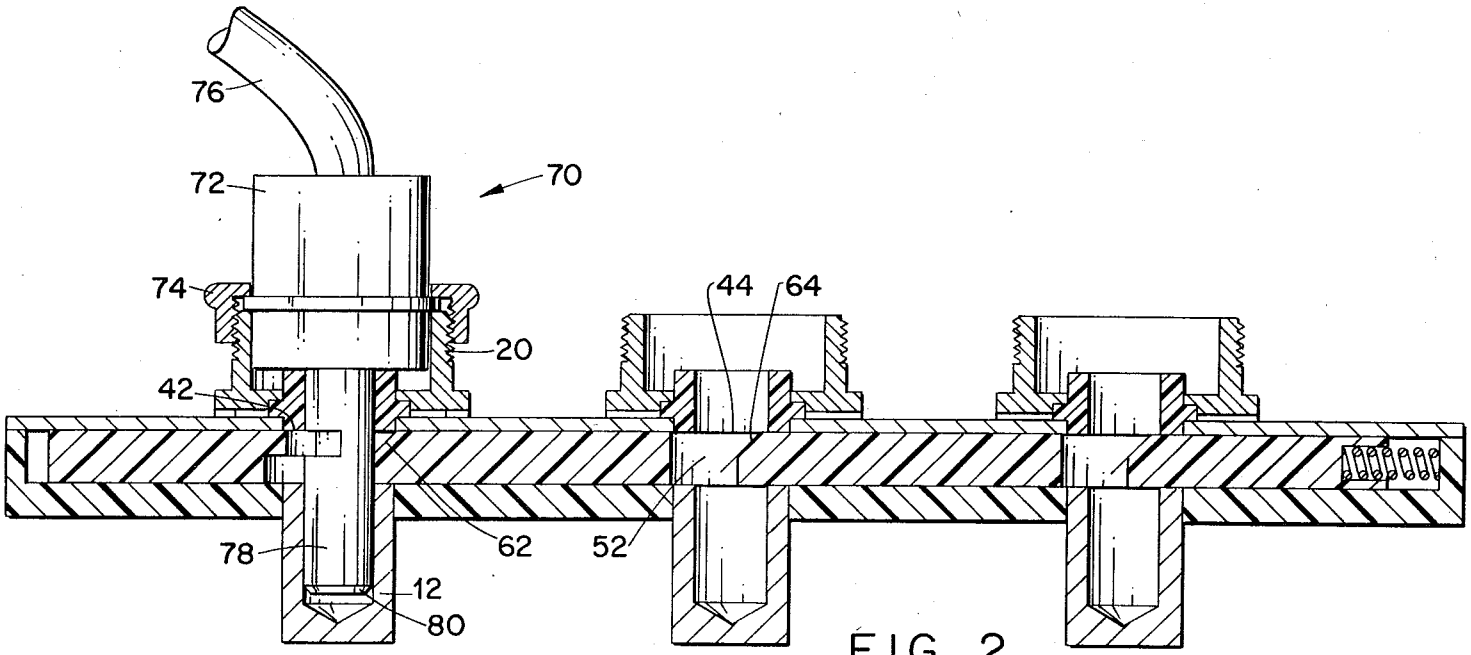
FIG. 2 is the same view as FIG. 1 with a ground contact inserted and the slide mechanism being in a second position.
Figure 3:
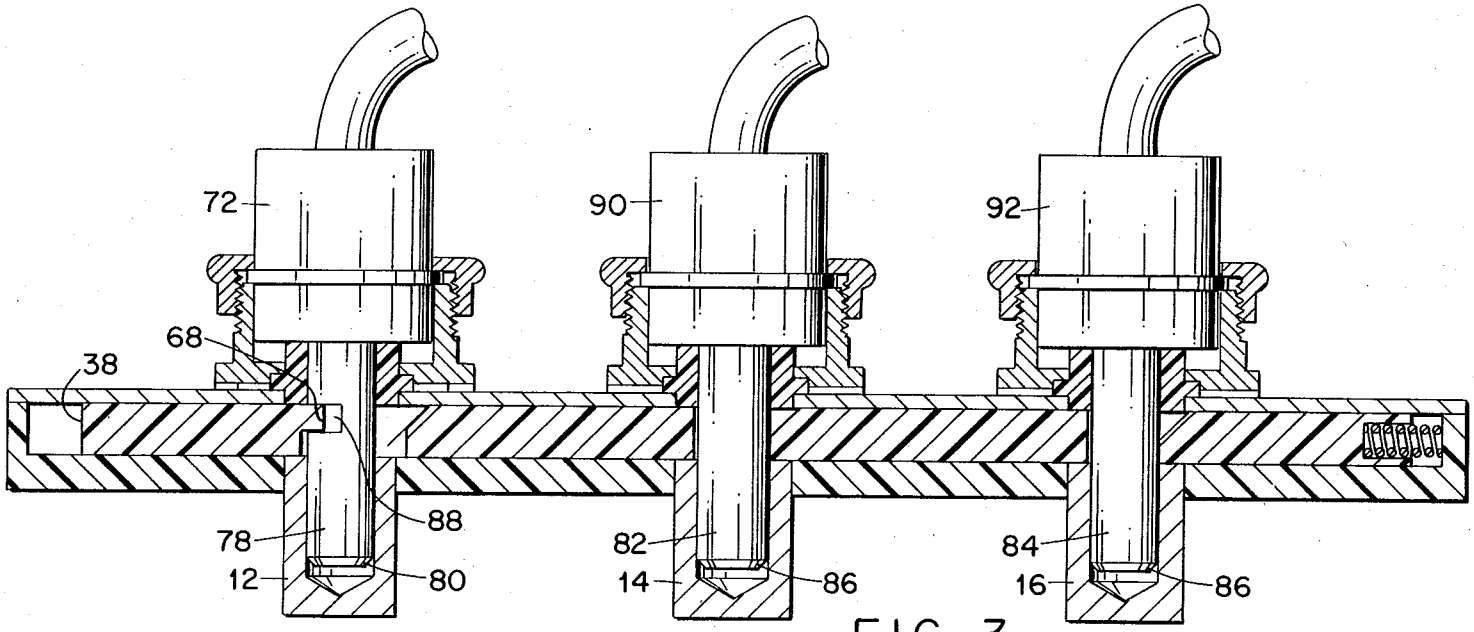
FIG. 3 is the same view as FIG. 2 except that the power contacts are also inserted and the slide mechanism is in a third position.

As can be seen in reference to FIG. 2, ground plug 70 includes connector body 72, locking ring 74, insulated conductor 76 and male contact 78. Coupling ring 74 is adapted to be screwed onto connector barrel 20 which is threaded on the outside in a standard fashion. Cable 76 is terminated to male contact 78. Male contact 78 includes incline surface 80 which makes contact with incline surface 62 of slide bar 32. As the male contact 70 is pressed through hole 42, incline 80 of the male contact makes contact with incline surface 62 of the slide bar causing the slide bar to move to the right. This enables bore holes 44 and 52 to become somewhat more aligned, as well as bore holes 46 and 54. The male contact is thus then fully inserted and seated in female contact 12. The sysem is thus properly grounded. This sliding of the bar to the right, as illustrated, enables male power contacts 82 and 84 to be inserted into their respective female contacts 14 and 16. For example, as male contact 82 is inserted into female contact 14 through bore hole 44, incline surface 86, as shown in FIG. 3, contacts incline surface 64, as shown in FIG. 2. This causes the slide bar to move further to the right, further compressing spring 34 and further moving end 38 away from side plate 30. As the male contact 82 is fully inserted into female contact 14, the slide bar is moved to the fully spring compressed position to the right, and pin 68, which protrudes from the slide bar, is inserted into cavity 88 of ground contact 78, thus locking in the ground male contact into the female contact 12. Once the male connectors 90 and 92 are removed from the system, i.e., the male contacts are removed from female contacts 14 and 16, the slide bar will return to its second position, thus causing pin 68 to be removed from cavity 88, thus unlocking the ground plug. As can be seen, it is impossible to either insert the power plugs 90 and 92 or retract the power plugs without first having the system grounded through the connection of the ground plug 72 to the ground contact 12.

Figure 4:
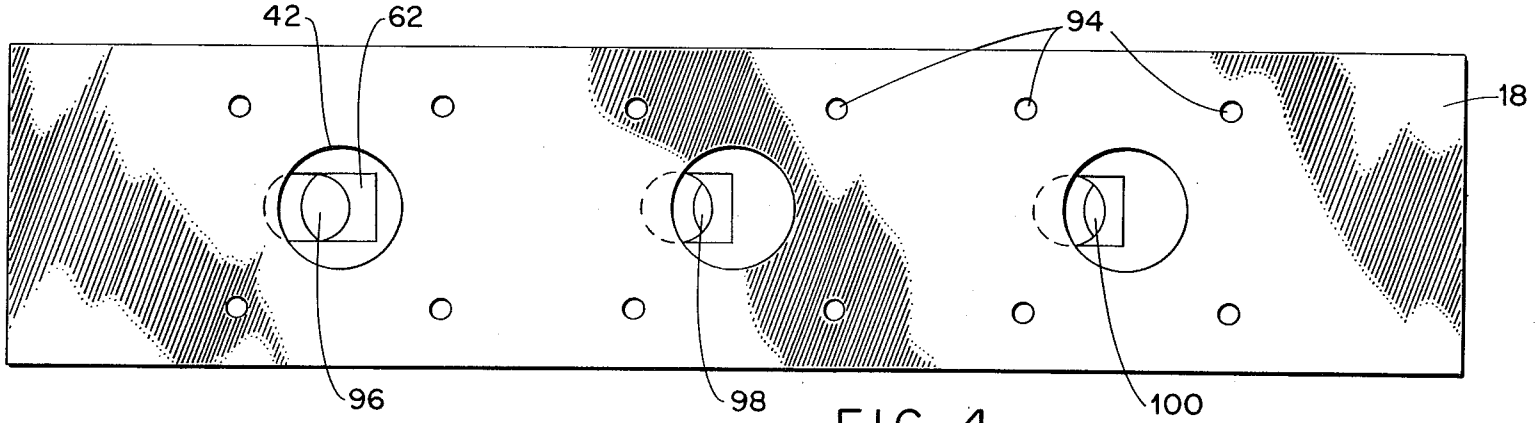
FIG. 4 is a top plan view of the power lock safety sysem of FIG. 1 with portions removed.

FIG. 4 shows a top plan view of FIG. 1 with the connectors 20, 22 and 24 removed. These connectors are adapted to be mounted through screw holes 94. As can be seen, the hole 96, which is the composite of bore hole 50 and the entrance to female contact 12, is somewhat larger than corresponding holes 98 and 100 due to the fact that the substrate covers more than 50% of the holes 44 and 46, as well as the holes 102 and 104 which form the hollow cylinder of female contacts 14 and 16. It is impossible to insert male plugs into these energized female contacts with the slide bar in the arrangement of FIGS. 1 and 4.

From the foregoing description of the embodiment of this invention it will be apparent that many modifications may be made therein. For example, the male and female contacts could be reversed without departing from the true spirit and scope of this invention.

I claim:

1. An interlock system for electrical power connections comprising:

at least three electrical contacts; two of said contacts adapted to receive electrical energy; the third contact adapted to be connected to ground; said electrical contacts adapted to be connected to three corresponding mating connectors;

said mating connectors not being encased in a common housing;

a slide bar having at least three bore holes therein; two of said bore holes having incline surfaces along a portion of one of their walls; spring means connected to said slide bar; each of said bore holes being in a slidable relation with and adjacent to a corresponding electrical contact; said slide bar having at least three positions, a first position such that said slide bar disables the connection of said electrical contacts which are adapted to provide electrical energy to its corresponding mating connector and a second position such that said slide bar enables the connection of said electrical contacts which are adapted to provide electrical energy to its corresponding mating connector; said slide bar being moved from said first position to said second position by the action of one of said mating connectors against said incline surface of one of said bore holes; said slide bar having a third position resulting from the action of another mating connector against the incline surface of a wall of another bore hole; said third position locking the connection of the contact which is adapted to be grounded to its corresponding mating connector.

2. An interlock system as set forth in claim 1, further including a pin protruding from said slide bar near one of said one bore holes; said pin protruding into a cavity in said electrical contact which is adapted to be connected to ground when said slide bar is in said third position.

3. An interlock system as set forth in claim 1, wherein said electrical contacts are female contacts and said mating connector are male contacts.

4. An interlock system as set forth in claim 1, wherein said bore holes and said electrical contacts respectively lie in approximate straight lines.

5. A method for interconnecting three independent electrical pins to an electrical connector, said connector including at least three electrical contacts, two of said contacts adapted to receive electrical energy, the third contact adapted to be connected to ground, said electrical contacts adapted to be connected to corresponding mating connectors, said mating connectors not being encased in a common housing; a slide bar having at least three bore holes therein, two of said bore holes having incline surfaces along a portion of their walls; spring means connected to said slide bore; each of said bore holes being in the slidable relation with an adjacent corresponding electrical contact; said slide bar having at least three positions; said method comprising the steps of:

placing said slide bar in a first position such that said slide bar disables the connection of said electrical contacts which are adapted to provide electrical energy to its corresponding mating connector; moving said slide bar in a second position such that said slide bar enables the connection of said electrical contacts which are adapted to provide electrical energy to its corresponding mating connector by the action of one of said mating connectors against the incline surface of one of the bore holes; again moving said slide bar to a third position resulting from the action of another mating connector against the incline surface of a wall of another bore hole; locking the connection of the contact adapted to be connected to ground to its corresponding mating connector.

* * * * *